US007808345B2

(12) United States Patent
Andoh et al.

(10) Patent No.: US 7,808,345 B2
(45) Date of Patent: Oct. 5, 2010

(54) DIELECTRIC RESONATOR OF CRUCIFORM SHAPE HAVING OFFSET PLANES AND A FILTER FORMED THERE FROM

(75) Inventors: Masamichi Andoh, Kyoto (JP); Kunihiro Komaki, Yokohama (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 12/261,493

(22) Filed: Oct. 30, 2008

(65) Prior Publication Data

US 2009/0039982 A1 Feb. 12, 2009

Related U.S. Application Data

(63) Continuation of application No. PCT/JP2007/056354, filed on Mar. 27, 2007.

(30) Foreign Application Priority Data

May 10, 2006 (JP) ..... 2006-131585

(51) Int. Cl.
*H01P 1/20* (2006.01)
*H01P 7/10* (2006.01)
*H01P 1/213* (2006.01)

(52) U.S. Cl. ..... 333/202; 333/219.1; 333/134

(58) Field of Classification Search ..... 333/202, 333/219.1, 134
See application file for complete search history.

(56) References Cited

U.S. PATENT DOCUMENTS

2003/0117244 A1* 6/2003 Matsuura et al. ..... 333/219
2004/0135654 A1* 7/2004 Karhu ..... 333/219.1
2004/0196120 A1* 10/2004 Andoh et al. ..... 333/202
2006/0176129 A1* 8/2006 Andreasson et al. ..... 333/202

FOREIGN PATENT DOCUMENTS

| | | |
|---|---|---|
| JP | 7-202530 | 8/1995 |
| JP | 2004-186712 | 7/2004 |
| WO | WO-2004-066430 | 8/2004 |

OTHER PUBLICATIONS

International Search Report PCT/JP2007/056354 dated Jun. 28, 2007.
Written Opinion PCT/JP2007/056354 dated Jun. 28, 2007.

* cited by examiner

*Primary Examiner*—Benny Lee
(74) *Attorney, Agent, or Firm*—Dickstein Shapiro LLP

(57) ABSTRACT

A dielectric resonator is constructed so as to have a substantially cruciform shape in cross section by including four plate components. A first set of opposed plate components have respective first principal center planes separated from each other and substantially parallel with each other. A second set of opposed plate components also have respective second principal center planes separated from each other and substantially parallel with each other. The first principal center planes are orthogonal to the second principal center planes. With this configuration, a TE01δy mode in which an electric-field vector rotates within the first set of opposed plate components and a TE01δz mode in which an electric-field vector rotates within the second set of opposed plate components are coupled.

14 Claims, 9 Drawing Sheets

FIG. 2(A) - PRIOR ART
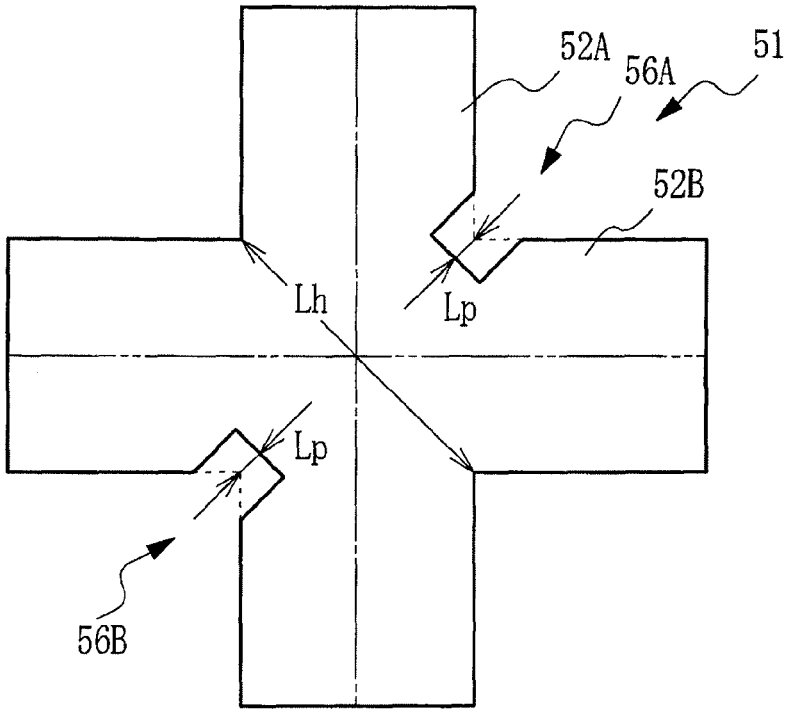
FIG. 2(B) – PRIOR ART
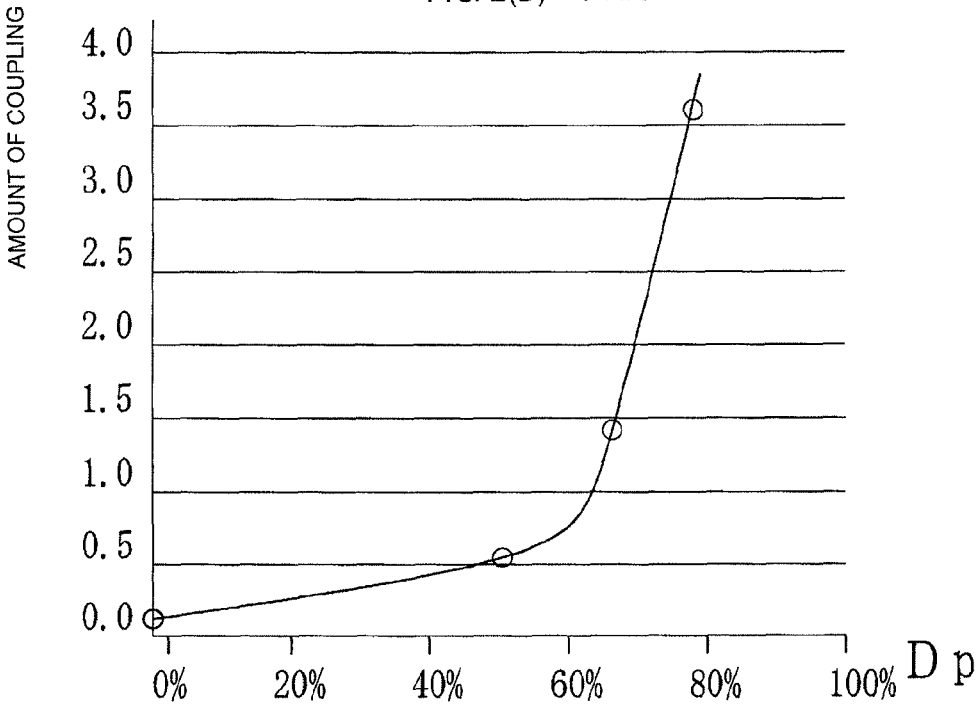

DIELECTRIC RESONATOR OF CRUCIFORM SHAPE HAVING OFFSET PLANES AND A FILTER FORMED THERE FROM

CROSS REFERENCE TO RELATED APPLICATIONS

The present application is a continuation of International Application No. PCT/JP2007/056354, filed Mar. 27, 2007, which claims priority to Japanese Patent Application No. JP2006-131585, filed May 10, 2006, the entire contents of each of these applications being incorporated herein by reference in their entirety.

FIELD OF THE INVENTION

The present invention relates to a dielectric resonator that utilizes a TE01δ mode resonant electromagnetic field, a dielectric filter that includes the resonator, and a communication device.

BACKGROUND OF THE INVENTION

One known example of a filter for a base station in mobile communications is a filter that includes a dielectric resonator in which electromagnetic fields of a plurality of TE01δ modes exist so as to be focused within the dielectric core (dual-mode TE01δ resonator). The dual-mode TE01δ resonator used in this filter achieves a characteristic of high unloaded Q (hereinafter referred to simply as "Qu") by use of a dielectric material having a small dielectric loss tangent (tan δ), so the filter can have a lower loss and excellent frequency selectivity. The representation TE01δ mode used here indicates one in a cylindrical (i.e., designated by axes θ, r, z) coordinate system (represented as TEθrz), and the same resonant mode is the TE110 mode when being represented in a Cartesian (i.e., designated by axes x, y, z) coordinate system (represented as TExyz).

Configurations in which a groove is provided in a part of a dielectric resonator and two resonant modes are coupled are disclosed in Patent Document 1 and Patent Document 2.

The configuration of the dielectric resonator illustrated in Patent Document 1 is described here on the basis of the perspective view of FIG. 1. A dielectric resonator 51 has the shape of a column of cruciform cross section, and two flat plate portions 52A and 52B form a dual-mode TE01δ resonator. The flat plate portions 52A and 52B have grooved portions 56A and 56B at their inner corners. The dielectric resonator 51 is bonded on a support table 55.

With such a configuration, a first TE01δ mode in which an electric-field vector rotates within the flat plate portion 52A occurs, and a second TE01δ mode in which an electric-field vector rotates within the flat plate portion 52B occurs. The electric-field vectors in the two TE01δ modes are distorted by the grooved portions 56A and 56B, and the above two TE01δ modes are coupled. The amount of this coupling is set by the depth and width dimensions of the grooved portions 56A and 56B.

Patent Document 2 discloses a dielectric resonator in which two TM110 modes are coupled by grooved portions.

Patent Document 1: Japanese Unexamined Patent Application Publication No. 2004-186712

Patent Document 2: Japanese Unexamined Patent Application Publication No. 7-202530

In general, for a band-pass filter that includes a plurality of stages of dielectric resonators, the amount of coupling between the resonators and the relative bandwidth of the filter are proportional to each other. Therefore, to obtain a filter having a large relative bandwidth, a dielectric resonator having a large amount of coupling is necessary. For example, to obtain a filter having a pass band of 60 MHz at 2 GHz range (the relative bandwidth is 3%), it is necessary to strongly couple the resonators with approximately 3%.

The effects of setting the amount of coupling by adjusting the depth dimension of the grooved portions in the configuration illustrated in Patent Document 1 is described here with reference to FIGS. 2(A) and 2(B). FIG. 2(A) is a front view of the dielectric resonator 51 illustrated in FIG. 1. When the dimension of an original diagonal line between the inner corners having no grooved portions in each of the flat plate portions 52A and 52B is Lh and the grooved portions 56A and 56B have the same depth dimension Lp, the ratio of the depth dimension of each of the grooved portions to the dimension of the original diagonal line (depth ratio Dp) is represented by the following expression:

$$Dp=2Lp/Lh$$

Here, the relationship between the depth ratio Dp and the amount of coupling is illustrated in FIG. 2(B). The horizontal axis indicates the depth ratio Dp, and the vertical axis indicates the amount of coupling.

When the depth ratio Dp is 0%, i.e., the grooved portions 56A and 56B are not formed, the amount of coupling is zero, and no coupling occurs. When the depth ratio Dp is below approximately 50%, the amount of coupling is at or below 0.5%, so only a small amount of coupling is set. To set the amount of coupling larger than 0.5%, it is necessary to set the depth ratio Dp at or above 50%.

In the case of the dielectric resonator illustrated in Patent Document 1, the amount of coupling can be set by adjusting the depth dimension of the grooved portion, as described above. However, to achieve the dielectric resonator having a large amount of coupling, it is necessary to set the depth dimension of the grooved portion at a significantly large value. For example, to obtain a filter characteristic of a relative bandwidth of 3%, it is necessary to achieve a dielectric resonator having an amount of coupling of approximately 3% by setting the depth ratio Dp of the grooved portion at approximately 75%, i.e., setting the material thickness between the inner corners of each of the flat plate portions at approximately ¼ of the dimension of the original diagonal line.

In production of the dual-mode TE01δ resonator having such a significantly deep grooved portion, a crack is apt to appear in the grooved portion and a cracking defect often occurs in the dielectric resonator during sintering of the dielectric resonator or during turning of the depth dimension (cutting) of the grooved portion. Therefore, the production is difficult.

In detail design of the dielectric resonator illustrated in Patent Document 1, it is necessary to repeat the following redesign loop.

1. Deepen the grooved portion.→2. The resonant frequency increases.→3. Increase the material thickness to lower the resonant frequency.→4. The amount of coupling reduces.→5. Deepen the grooved portion.

This process causes the dielectric resonator to have a significantly large material thickness, so the size of the dielectric resonator is larger, compared with that of a standard-shaped dielectric resonator having the same resonant frequency and having no grooved portion. Therefore, the dielectric resonator illustrated in Patent Document 1 may fail to form a smaller filter.

To accommodate the dielectric resonator having a large size in a cavity, unless the size of the cavity is large, the proportion of the dielectric resonator in the cavity is increased. This reduces the frequency in the spurious mode (TM mode) occurring in the cavity, and adverse effects are exerted on a required attenuation range.

For the dielectric resonator having an overall material thickness larger than that of a standard-shaped one, the Qu characteristic is poorer than that of the standard-shaped dielectric resonator. As a result, there is a limit to a reduction in loss of a filter using the dielectric resonator illustrated in Patent Document 1.

SUMMARY OF THE INVENTION

Accordingly, it is an object of the present invention to provide a dielectric resonator that achieves a desired amount of coupling with an optimal Qu characteristic, resonant frequency, and resonator size while being less prone to suffer from cracking defects at its inner corners. It is another object of the present invention to provide a low-loss small filter and communication device that include the dielectric resonator.

In the following description, in a dielectric resonator having the shape of a column of cruciform cross section, each branch portion of the cross shape is referred to as a plate component. A plane that divides each plate component into two equal parts in its thickness direction is referred to as a principal center plane. The term "parallel" indicates the concept including "substantially parallel," and the term "orthogonal" indicates the concept including "substantially orthogonal."

A dielectric resonator according to the invention includes first and second plate components having their respective principal center planes being parallel with each other and third and fourth plate components having their respective principal center planes being parallel with each other and orthogonal to the principal center planes of the first and second plate components. The dielectric resonator has a cross section orthogonal to all of the principal center planes, the cross section having a substantially cruciform shape. The principal center plane of the first plate component and the principal center plane of the second plate component are separated from each other, and a first TE01δ mode in which an electric-field vector rotates within the first and second plate components and a second TE01δ mode in which an electric-field vector rotates within the third and fourth plate components are coupled.

With this configuration, the first TE01δ mode in which an electric-field vector rotates within the first and second plate components occurs, and the second TE01δ mode in which an electric-field vector rotates within the third and fourth plate components occurs. By use of these first and second TE01δ modes, the dual-mode TE01δ resonator is formed.

Because the principal center planes of the first and second plate components within which the first TE01δ mode occurs are separated from each other, the electric-field vector rotating within the first and second plate components is inclined, compared with a state in which the principal center planes of the first and second plate components coincide with each other. As a result, the first TE01δ mode having this inclined electric-field vector is coupled to the second TE01δ mode. The amount of this coupling can be adjusted by adjusting the distance between the principal center planes of the first and second plate components.

In the dielectric resonator according to the invention, the principal center plane of the third plate component and the principal center plane of the fourth plate component are separated from each other.

With this configuration, because the principal center planes of the third and fourth plate components within which the second TE01δ occurs are separated from each other, the electric-field vector rotating within the third and fourth plate components is inclined, compared with a state in which the principal center planes of the third and fourth plate components coincide with each other. As a result, the second TE01δ mode having this inclined electric-field vector is coupled to the above first TE01δ mode. The amount of this coupling can also be adjusted by adjusting the distance between the principal center planes of the third and fourth plate components.

In the dielectric resonator according to the invention, a surface that contains a line of intersection of the principal center planes of two adjacent plate components among the first to fourth plate components or a surface near to the line of intersection has at least one grooved portion extending in parallel with the line of intersection.

With this configuration, the grooved portion causes the inclination of the electric-field vector rotating within the first and second plate components and the inclination of the electric-field vector rotating within the third and fourth plate components to change in a direction in which it becomes larger or a direction in which it becomes smaller. As a result, the amount of coupling can be adjusted by adjusting the depth and width dimensions of the grooved portion.

A filter according to the invention includes the aforementioned dielectric resonator, a cavity for accommodating the dielectric resonator therein, a first input/output portion for inputting/outputting a signal while being coupled to either the first or second TE01δ mode, and a second input/output portion for inputting/outputting a signal while being coupled to either the first or second TE01δ mode.

In the filter according to the invention, at least one of the first and second input/output portions comprises a semi-coaxial cavity resonator.

A communication device according to the invention includes, in a radio-frequency circuit portion, the aforementioned dielectric resonator or the aforementioned dielectric filter.

With the configuration in which the principal center planes of the first and second plate components are separated from each other, a grooved portion formed in an inner corner of each of the plate components is not necessarily required. As a result, the first and second TE01δ modes can be coupled without causing the material thickness at the inner corner to become significantly small.

This can reduce the proportion of cracking defects appearing in the inner corner of each of the plate components. The dual-mode TE01δ resonator can be constructed merely by slightly displacing the position of the inner corner of each of the plate components with respect to a standard shape, and the dielectric resonator having an optimal resonant frequency, Qu characteristic, and resonator size is obtainable. A desired amount of coupling is obtainable by adjusting the distance between the principal center planes of the first and second plate components.

With the configuration in which the principal center planes of the third and fourth plate components are separated from each other, a desired amount of coupling can also be obtained by adjusting the distance between the principal center planes of the third and fourth plate components. As a result, the dielectric resonator having a desired amount of coupling can be obtained while achieving an optimal Qu characteristic, resonant frequency, and resonator size. The amount of coupling can be significantly large.

With the configuration in which the surface has the grooved portion extending in parallel with the line of intersection of the principal center planes of the two adjacent plate components in the vicinity of this line of intersection, the amount of coupling can be finely adjusted by adjusting the depth and width dimensions of the grooved portion. Depending on the position where the grooved portion is formed, adjustment of weakening the coupling can be performed. As a result, the dielectric resonator having a desired amount of coupling with an optimal Qu characteristic, a desired resonant frequency, and a small resonator size is obtainable.

With the filter configuration in which the aforementioned dielectric resonator is accommodated in the cavity, the filter can have a smaller size and a lower loss. A high frequency in the spurious mode (TM mode) occurring in the cavity can be maintained while maintaining a small filter size, and a necessary attenuation range is obtainable.

As the input/output portions, by use of the semi-coaxial cavity resonator, propagation in the spurious mode (TM mode) can be blocked.

With the configuration of the communication device including the aforementioned dielectric resonator or the aforementioned dielectric filter, the communication device can have a smaller size and a lower loss.

BRIEF DESCRIPTION OF DRAWINGS

FIG. 2(A) is a front view of the dielectric resonator illustrated in FIG. 1.

FIG. 2(B) illustrates a correlation between the amount of coupling and the depth dimension in the dielectric resonator shown in Patent Document 1.

REFERENCE NUMERALS

Figure 1:
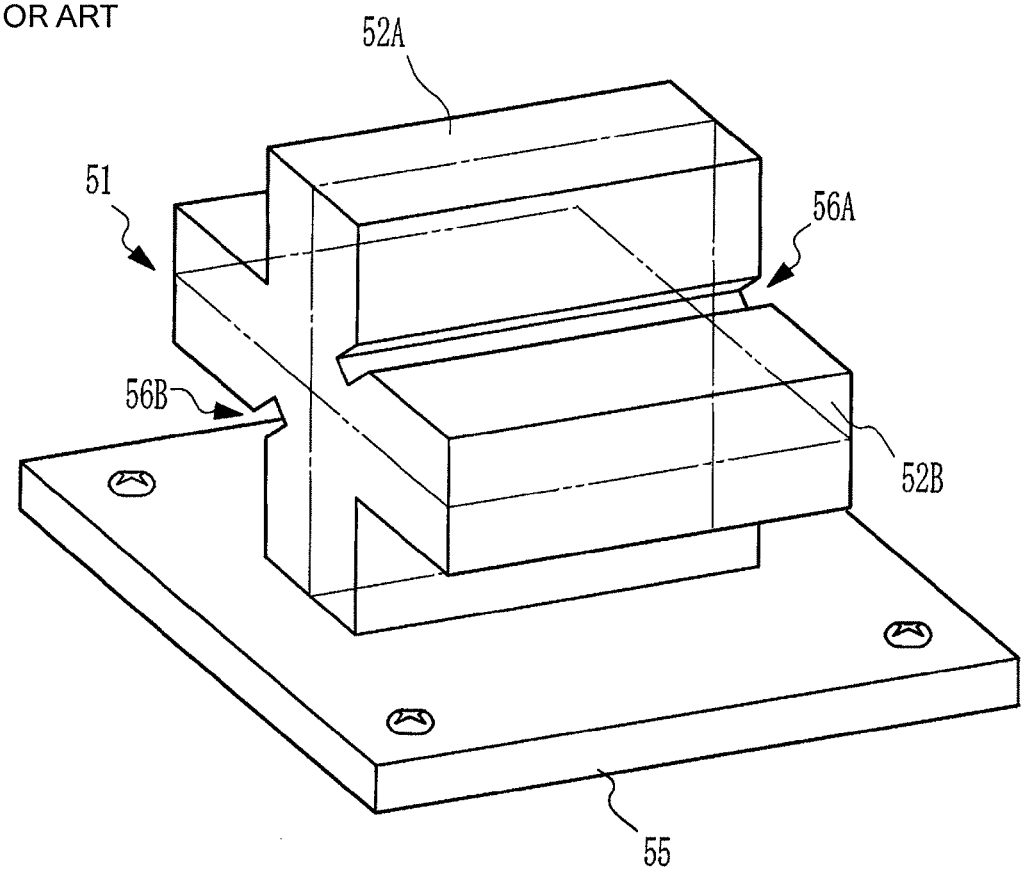
FIG. 1 PRIOR ART
FIG. 1 is a perspective view of a dielectric resonator shown in Patent Document 1.

1, 51 dielectric resonator
2A, 2B, 2C, 2D plate component
3A, 3B, 3C, 3D principal center plane
5, 55 support table
6 cavity
11 central conductor
12 coaxial connector
13 frequency adjusting screw
20 partition plate
21 conductor loop
30 filter
52A, 52B flat plate portion
56A, 56B grooved portion
R1, R23, R45, R6 resonator
E1, E2 electric-field vector
W window

DETAILED DESCRIPTION OF THE INVENTION

A dielectric resonator 1 according to a first embodiment and a communication filter that includes the dielectric resonator 1 will be described below with reference to FIGS. 3, 4(A), 4(B), 4(C), 5(A), 5(B), 6(A), 6(B), 7(A) and 7(B). In the following description, the mounting plane of the dielectric resonator is an X-Y plane in the Cartesian coordinate system, and an axis orthogonal to the X-Y plane is the z-axis. It should be noted that in the following description and drawing figures, like features in the various drawings are designated by the same reference labels and the detailed description thereof is omitted.

Figure 3:
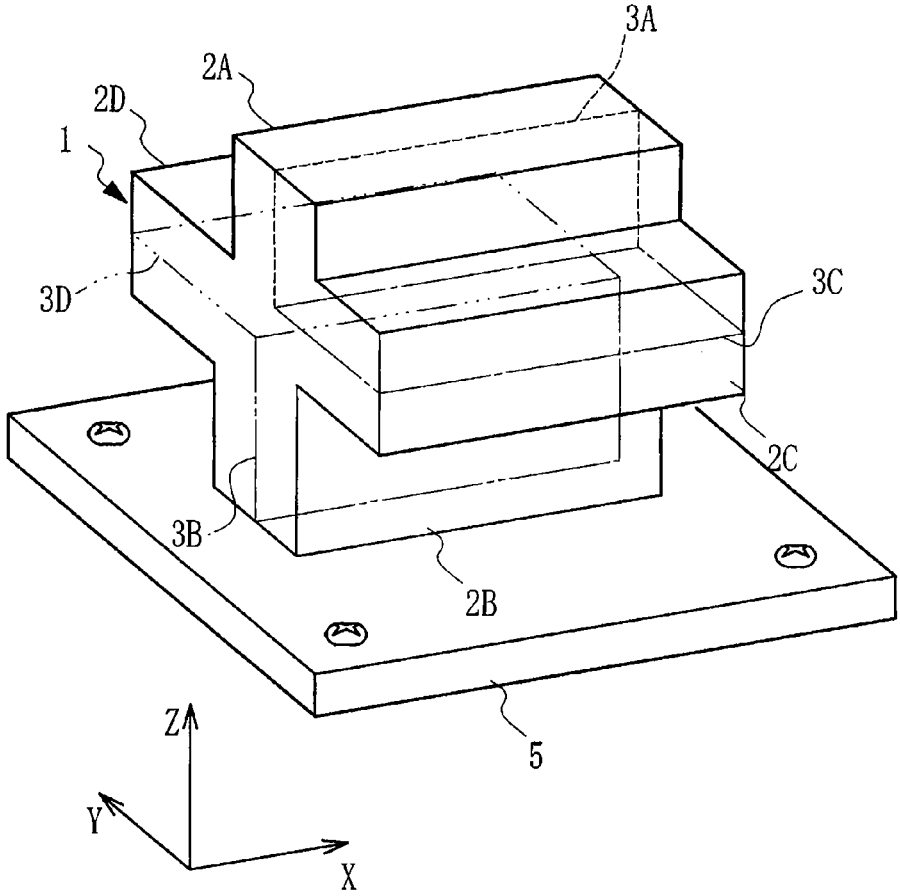
FIG. 3 is a perspective view of a dielectric resonator according to a first embodiment.

FIG. 3 is a perspective view that shows a main configuration of the dielectric resonator. This dielectric resonator 1 is joined onto a support table 5 by bonding of an adhesive or baking of glass glaze. The plane where the dielectric resonator 1 and the support table 5 are joined together is the mounting plane of the dielectric resonator 1.

The dielectric resonator 1 is a single columnar block formed by the sintering of titanium oxide ceramic having a permittivity of 49 and includes plate components 2A, 2B, 2C and 2D such that its cross section (Y-Z plane) orthogonal to the axial direction (x-axis direction) of the columnar block has a substantially cruciform shape. Each of the plate components 2A to 2D has a material thickness of approximately 10 mm and an outer dimension of approximately 23 mm in each of the x-axis, y-axis, and z-axis directions. The dielectric resonator 1 has a Qu value set at 9,500 to 10,000 and a resonant frequency set at approximately 2 GHz.

Figure 4A:
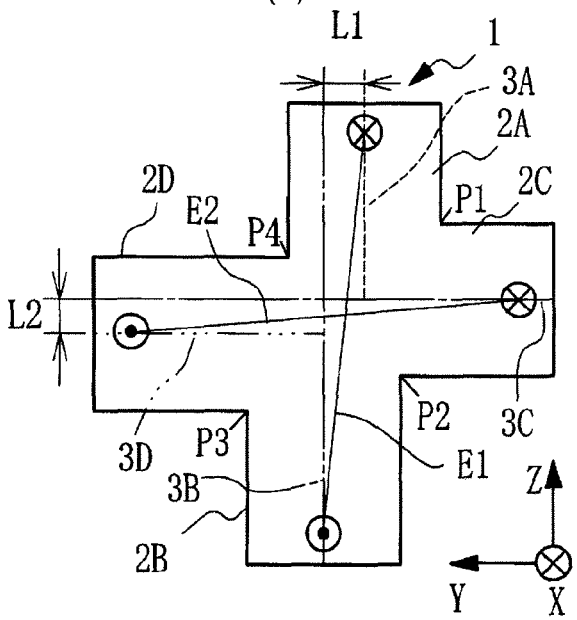
FIGS. 4(A), 4(B) and 4(C) are front plan, right plan and bottom plan views of the dielectric resonator according to the one embodiment of the present invention.
Figure 4B:
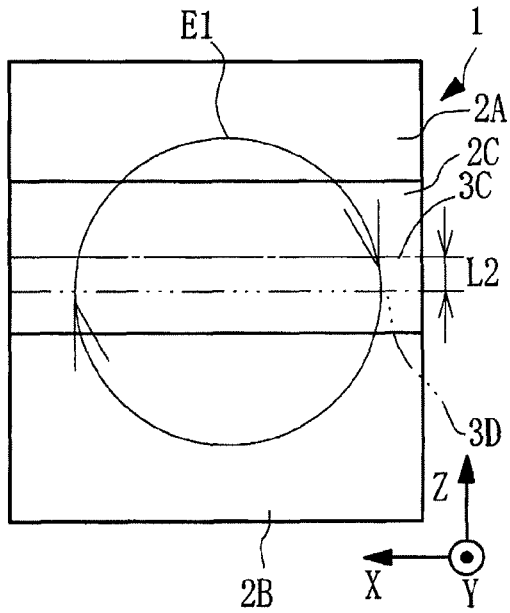
Figure 4C:
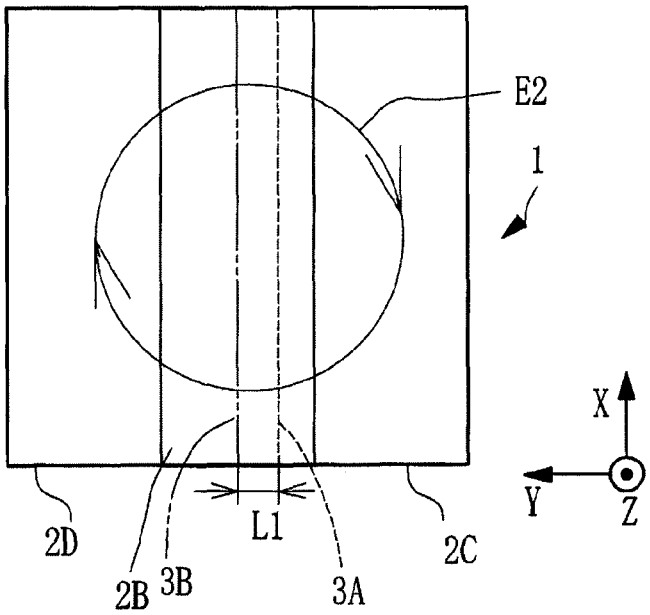

FIGS. 4(A), 4(B) and 4(C) are three-views of the dielectric resonator 1; FIG. 4(A) illustrates a front view (Y-Z plane) orthogonal to the x-axis, FIG. 4(B) illustrates a side view (X-Z plane) orthogonal to the y-axis, and FIG. 4(C) illustrates a bottom view (X-Y plane) orthogonal to the z-axis. Among principal center planes 3A, 3B, 3C and 3D dividing the respective plate components 2A, 2B, 2C and 2D into two equal parts in respective thickness directions, the principal center plane 3A of the plate component 2A and the principal center plane 3B of the plate component 2B are orthogonal to the y-axis, and the principal center plane 3C of the plate component 2C and the principal center plane 3D of the plate component 2D are orthogonal to the z-axis.

With such a configuration, a TE01δy resonant mode in which an electric-field vector E1 rotates in the X-Z plane within the plate components 2A and 2B occurs (as shown in FIG. 4(B), and a TE01δz resonant mode in which an electric-field vector E2 rotates in the X-Y plane within the plate components 2C and 2D occurs (as shown in FIG. 4(C)).

Here, the principal center plane 3B of the plate component 2B is an X-Z plane that passes through the middle point in the outer dimension of the dielectric resonator 1 in the y-axis direction, and the principal center plane 3A of the plate component 2A is an X-Z plane that is separated from the principal center plane 3B by a dimension L1 (FIGS. 4(A) and 4(C)) in the negative y-axis direction. The principal center plane 3D of the plate component 2D is an X-Y plane that passes through the middle point in the outer dimension of the dielectric resonator 1 in the z-axis direction, and the principal center plane 3C of the plate component 2C is an X-Y plane that is separated from the principal center plane 3D by a dimension L2 (FIGS. 4(A) and 4(B)) in the positive z-axis direction.

In the plate components 2A and 2B, because the principal center planes 3A and 3B are separated from each other, the electric-field vector E1 is inclined toward the y-axis direction. In the plate components 2C and 2D, because the principal center planes 3C and 3D are separated from each other, the electric-field vector E2 is inclined toward the z-axis direction. As a result, both the electric-field vectors E1 and E2 have their respective vector components in the Y-Z plane. Here, their respective vector components of the electric-field vectors E1 and E2 in the Y-Z plane intersect with each other at non-right angles, thus coupling the TE01δy mode and TE01δz mode. The amount of this coupling can be set by the separation dimensions L1 and L2.

With such a configuration, the TE01δz mode and the TE01δy mode are coupled in the dielectric resonator 1. Because they are coupled while the principal center planes of the plate components 2A to 2D are separated from each other, the dielectric resonator has no portion where its material thickness is significantly small on the whole. As a result, the dielectric resonator is less prone to suffer from cracking defects. The material thickness of each of the plate components and the outer dimension of the dielectric resonator are substantially the same as the outer dimension of a standard shape that enables an optimal resonant frequency and an optimal Qu value, so a desired resonant frequency and an excellent Qu characteristic are obtainable.

Next, effects of adjustment of separation dimensions of the dielectric resonator according to the present invention will be described on the basis of FIGS. 5(A), 5(B), 6(A), 6(B), 7(A) and 7(B) using the results of simulation of adjusting the amount of coupling in the dielectric resonator done by the inventors.

Figure 5A:
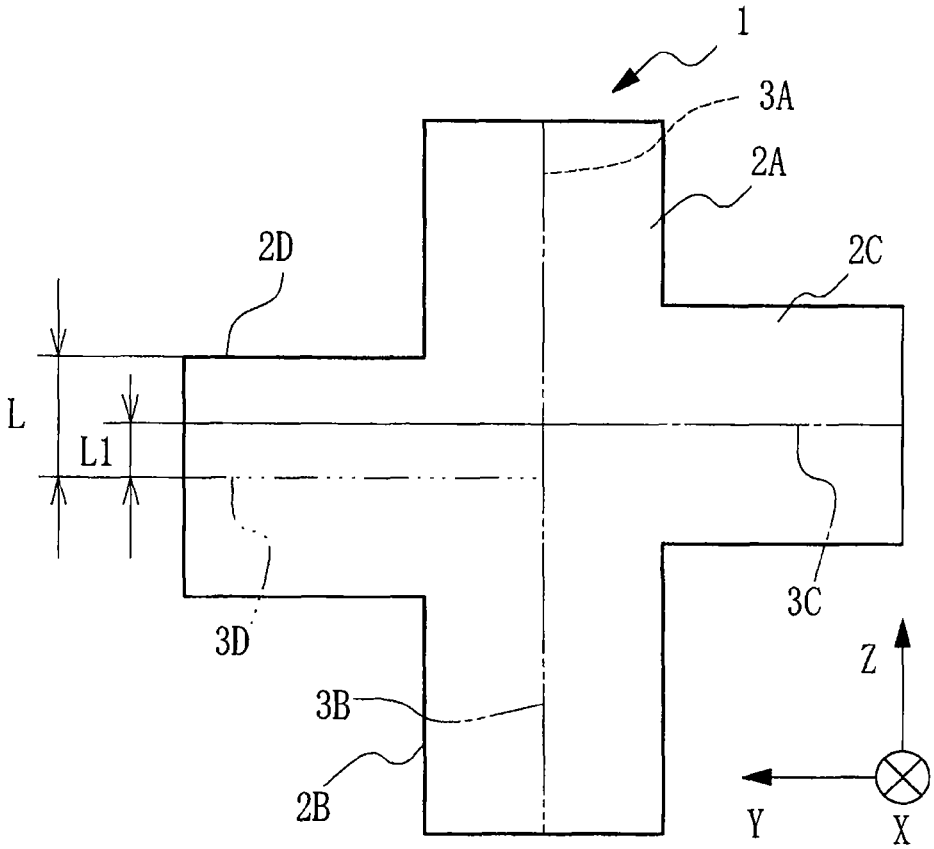
FIG. 5(A) illustrates a dielectric resonator having one plate component displaced in the z-axis direction.

First, FIG. 5(A) illustrates an example configuration of the dielectric resonator having a shape in which the plate component 2C is displaced in the z-axis direction. Here, the shape in which none of the plate components are displaced is a standard shape, the separation dimension of the plate component 2C from the standard shape is L1, and the dimension from the principal center plane of each of the plate components to its surface is L. The ratio of displacement of the separation dimension of the plate component 2C to the original standard shape (displacement ratio Dt) is represented by the following expression:

$$Dt=L1/L$$

Figure 5B:
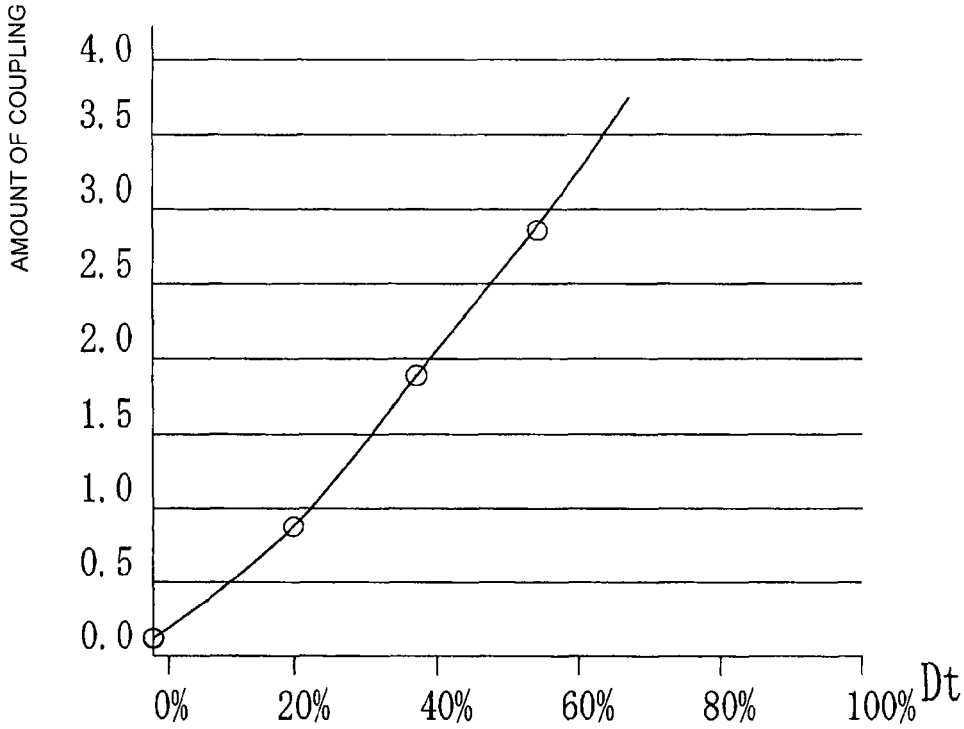
FIG. 5(B) illustrates a relationship between the amount of coupling and a displacement dimension in the dielectric resonator of FIG. 5(A).

Here, the relationship between the displacement ratio Dt and the amount of coupling is illustrated in FIG. 5(B).

When the displacement ratio Dt is 0%, i.e., the separation dimension L1 is zero and the plate component 2C is not displaced, no coupling occurs. However, the amount of coupling linearly increases with an increase in the displacement ratio Dt, so the amount of coupling can be set in a wide range. For example, to achieve a dielectric resonator having an amount of coupling of approximately 3% to use it in a filter having a relative bandwidth of 3%, it is necessary to set the displacement ratio Dt of the plate component 2C at approximately 60%.

Figure 6A:
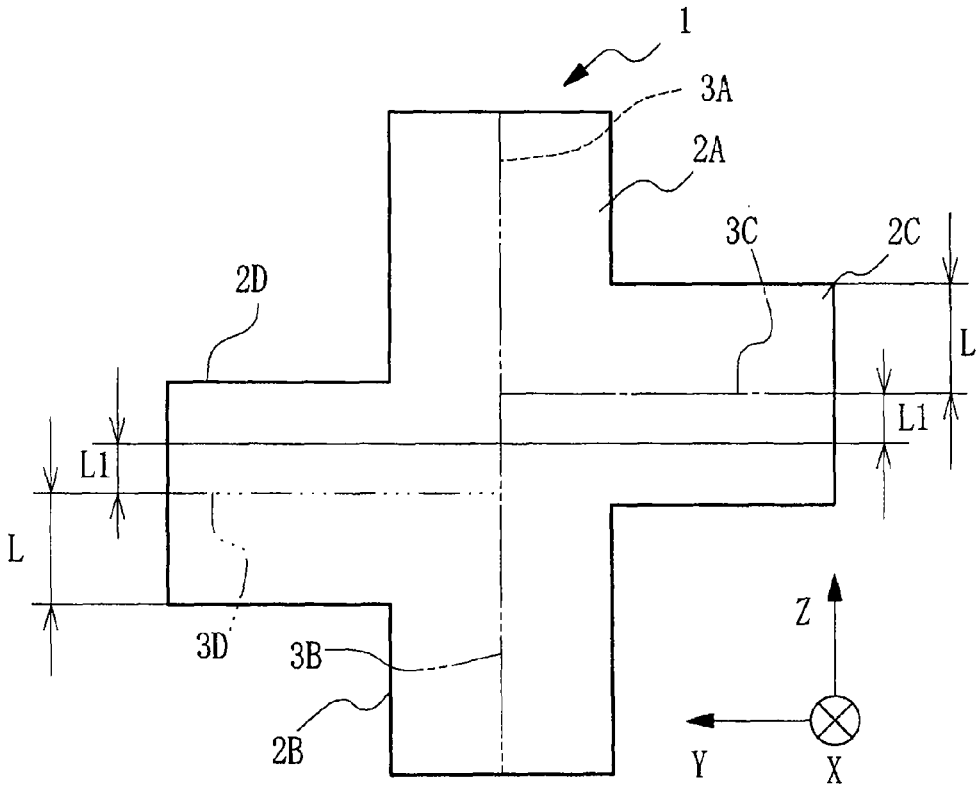
FIG. 6(A) illustrates a dielectric resonator in which two plate components are oppositely displaced in the z-axis direction.

Next, FIG. 6(A) illustrates an example configuration of the dielectric resonator in which, in addition to the plate component 2C, the plate component 2D is also displaced by the same dimension toward the opposite side. Here, the separation dimension of each of the plate components 2C and 2D from the standard shape is L1, the dimension from the principal center plane of each of the plate components to its surface is L, and the displacement ratio is Dt.

Figure 6B:
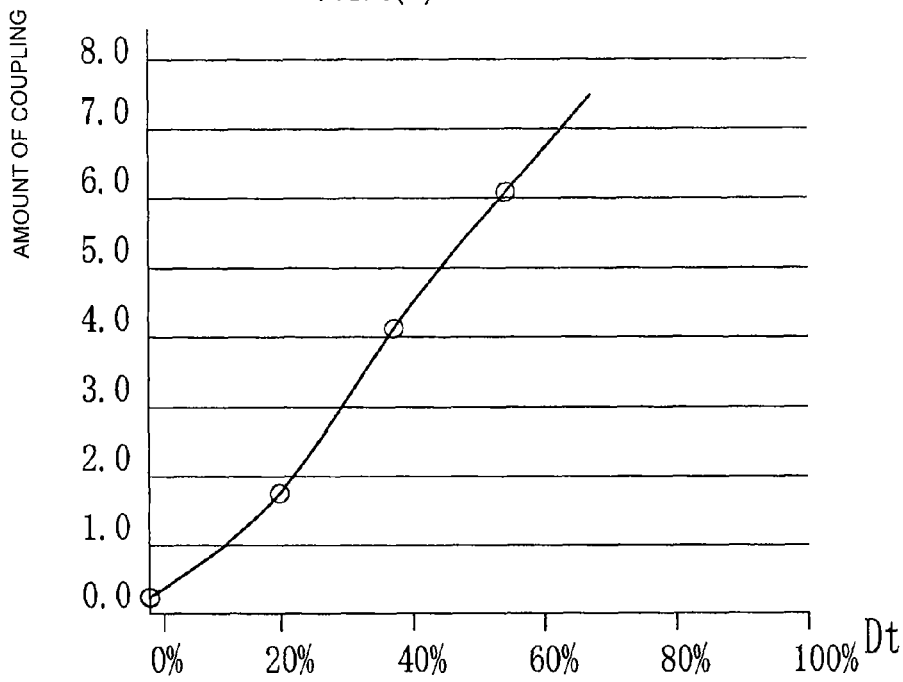
FIG. 6(B) illustrates a relationship between the amount of coupling and a displacement dimension in the dielectric resonator of FIG. 6(A).

Here, the relationship between the displacement ratio Dt and the amount of coupling is illustrated in FIG. 6(B).

When the displacement ratio Dt is 0%, i.e., the separation dimension L1 is zero and the plate components 2C and 2D are not displaced, no coupling occurs. However, the amount of coupling linearly increases with an increase in the displacement ratio Dt, so the amount of coupling can be set in a wide range. Specifically, to achieve a dielectric resonator having an amount of coupling of approximately 3%, it is necessary to set the displacement ratio of each of the plate components 2C and 2D at approximately 30%. In such a way, displacing both the two plate components can offer a large amount of coupling with approximately a half amount of displacement, compared with when only one plate component is displaced, as in FIG. 5(A).

Figure 7A:
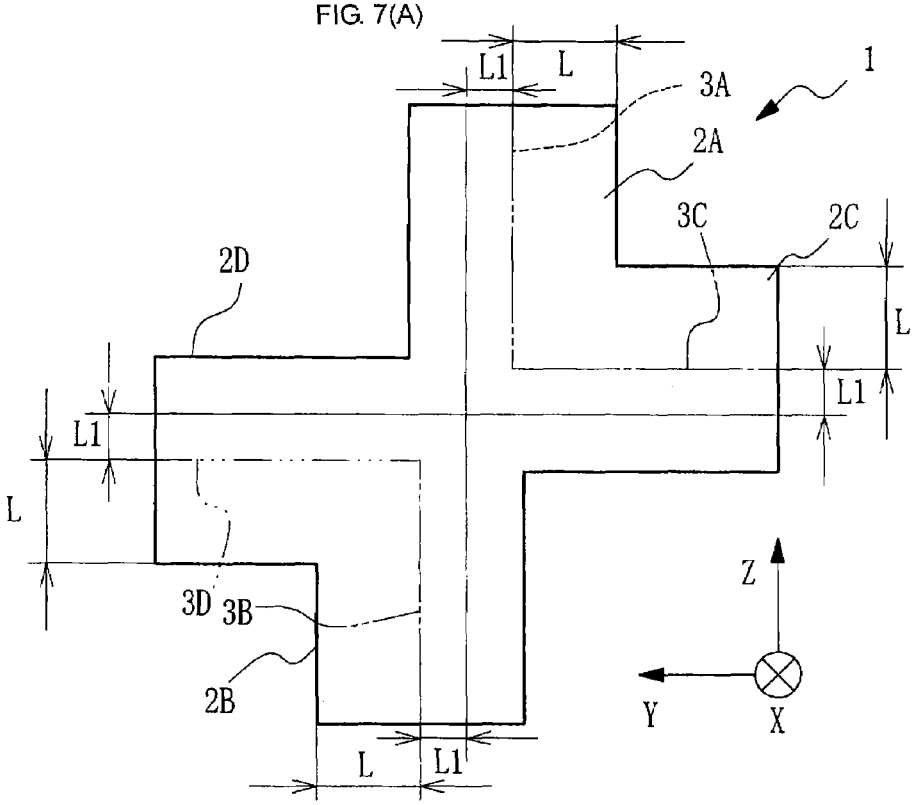
FIG. 7(A) illustrates a dielectric resonator in which all plate components are displaced in their respective axis directions.

Next, FIG. 7(A) illustrates an example configuration of the dielectric resonator in which all the plate components 2A, 2B, 2C and 2D are displaced by the same dimension. Here, the separation dimension of each of the plate components 2A, 2B, 2C and 2D from the standard shape is L1, the dimension from the principal center plane of each of the plate components to its surface is L, and the displacement ratio is Dt.

Figure 7B:
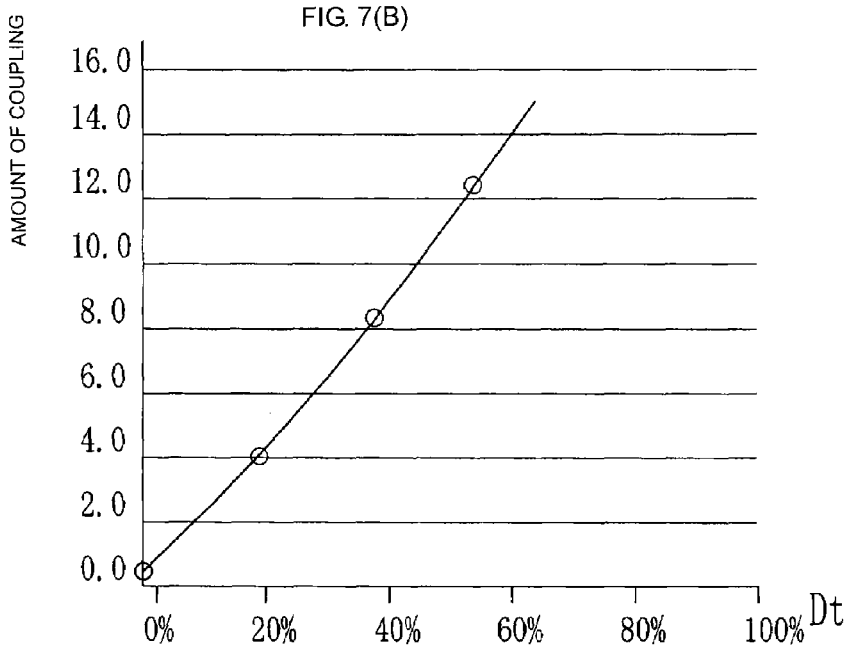
FIG. 7(B) illustrates a relationship between the amount of coupling and a displacement dimension in the dielectric resonator of FIG. 7(A).

Here, the relationship between the displacement ratio Dt and the amount of coupling is illustrated in FIG. 7(B).

When the displacement ratio Dt is 0%, i.e., the separation dimension is zero and the plate components 2A to 2D are not displaced, no coupling occurs. However, the amount of coupling linearly increases with an increase in the displacement ratio Dt, so the amount of coupling can be set in a wide range. Specifically, to achieve a dielectric resonator having an amount of coupling of approximately 3%, it is necessary to set the displacement ratio of each of the plate components 2A to 2D at approximately 15%. In such a way, displacing all the plate components can offer a large amount of coupling with approximately a quarter amount of displacement, compared with when only one plate component is displaced, as in FIG. 5(A).

As illustrated in the example configurations of the dielectric resonator described above, according to the present invention, no matter which plate component may be displaced, the TE01δ modes can be coupled similarly and the amount of coupling can be set by the amount of displacement.

In the above-described configurations, the plate components are displaced by the same amount. However, the present invention is not limited to these configurations and can be suitably carried out even with the configuration in which the plate components are displaced by different amounts. The direction in which each of the plate components is displaced may be different from that in the above-described configurations.

In some cases, depending on sintering of a dielectric, the plate components may undergo a distortion or a warp from its designed shape or a displacement from their respective axis directions in some degree, so it may be difficult to precisely shape each product. In such cases, the principal center planes are distorted, and they are not exactly parallel or exactly orthogonal. The present invention can be carried out with such a configuration, in which the principal center planes are substantially parallel or substantially orthogonal. In such cases, the amount of coupling of the TE01δz mode and the TE01δy mode in the dielectric resonator 1 may differ from product to product, and thus the amount of coupling as designed may be unobtainable. In this case, a grooved portion 60A, 60B, 60C, 60D similar to that shown in FIGS. 1 and 2(A) extending in the x-axis direction may be provided between adjacent plate components of the plate components 2A, 2B, 2C and 2D, and the amount of coupling of the TE01δz mode and the TE01δy mode may be corrected by fine adjustment of its depth dimension and width dimension. See FIGS. 10(A), 10(B), 10(C) and 10(D). Even if such a grooved portion 60A, 60B, 60C, 60D is provided, because the amount of coupling is not solely dependent on the depth dimension of the grooved portion 60A, 60B, 60C, 60D, a small depth dimension of the grooved portion is sufficient. As a result, a portion where the material thickness is significantly small on the whole of the dielectric resonator can be avoided.

Figure 10A:
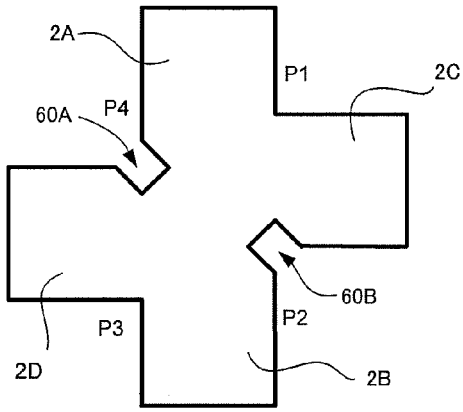
FIGS. 10(A), 10(B), 10(C) and 10(D) are front plan views of embodiments of the dielectric resonator of the present invention incorporating grooved portions.
Figure 10C:
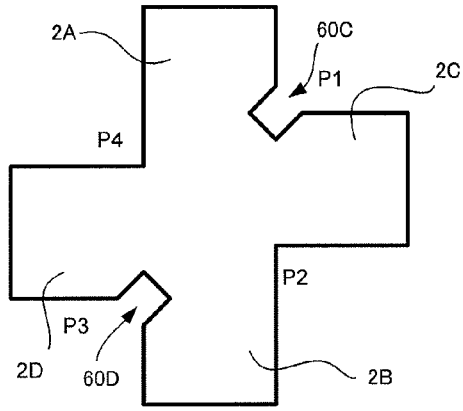
Figure 10B:
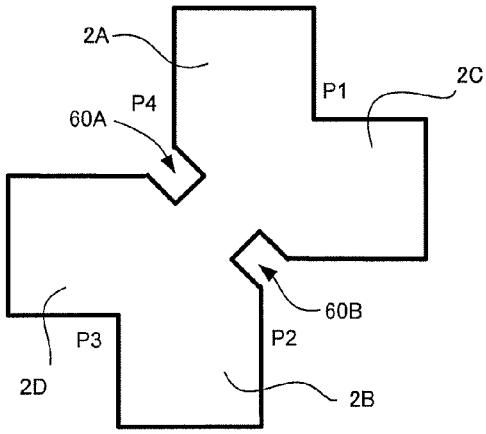
Figure 10D:
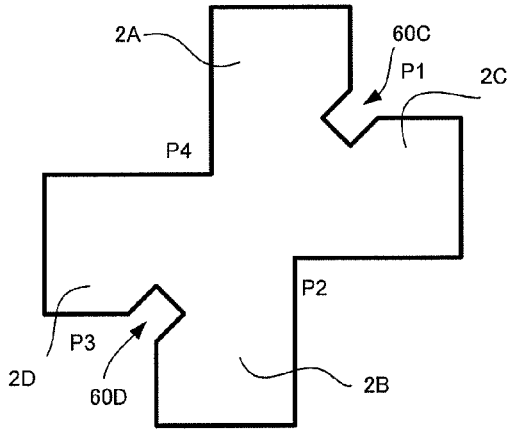

Here, the adjustment of the amount of coupling by the addition of the grooved portion 60A, 60B, 60C, 60D will be described concretely. The resonant frequency of the coupling mode in which an electromagnetic field travels across the plate components 2A, 2C and the plate components 2B, 2D (even mode or odd mode) and the coupling mode in which an electromagnetic field travels across the plate components 2A, 2D and the plate components 2B, 2C (odd mode or even mode) can be adjusted by the provision of the grooved portion 60A, 60B, 60C, 60D. In the above embodiments shown in FIGS. 10(A), 10(B), 10(C) and 10(D), the dimension of a line from an inner corner P1 of the adjacent plate components 2A, 2C to an inner corner P3 of the plate components 2B, 2D is longer than the dimension of a line from an inner corner P2 of the plate components 2C, 2B to an inner corner P4 of the plate components 2D, 2A. Providing the grooved portion 60A, 60B further reducing the dimension of the line from corner P2 to corner P4 as shown in FIGS. 10(A) and 10(B) can increase the difference between the resonant frequency in the even mode and the resonant frequency in the odd mode and thus can enhance the amount of coupling. Providing the grooved portion 60C, 60D reducing the dimension of the line from corner P1 to corner P3 as shown in FIGS. 10(C) and 10(D) can reduce the difference between the resonant frequency in the even mode and the resonant frequency in the odd mode and thus can decrease the amount of coupling.

Next, a configuration of a filter according to a second embodiment of the present invention will be described with reference to FIGS. 8(A) and 8(B).

Figure 8A:
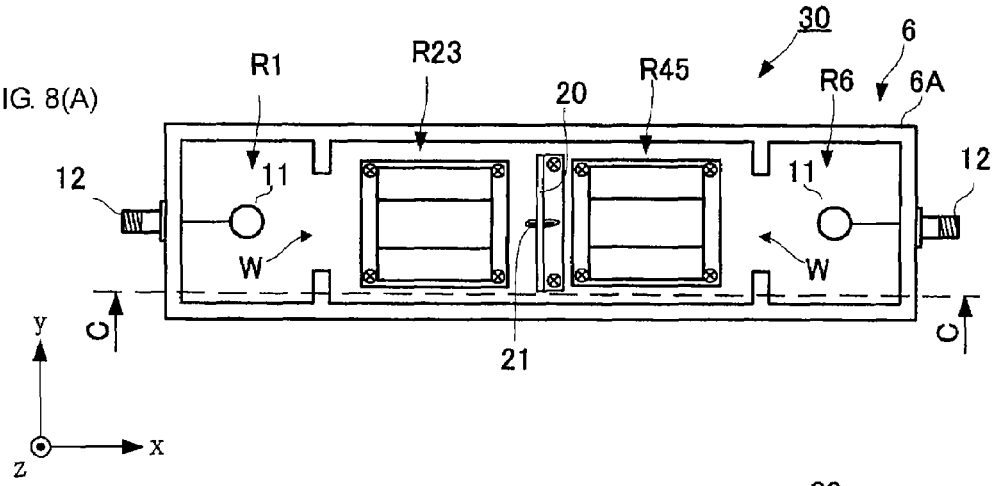
FIGS. 8(A) and 8(B) illustrate a filter according to a further embodiment of the present invention.
Figure 8B:
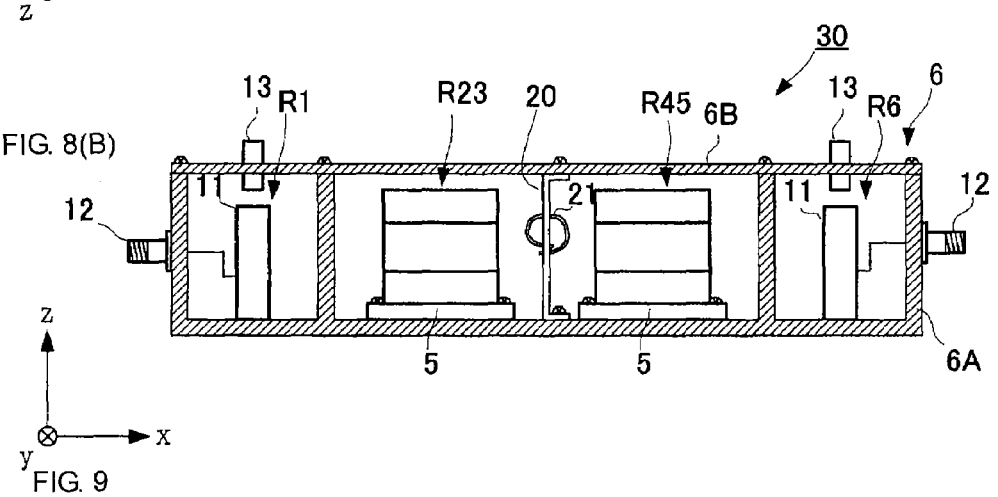

FIGS. 8(A) and 8(B) illustrate a configuration of a filter 30 for use in communication including the dielectric resonator. FIG. 8(A) is a top view of the filter 30 with a top cavity cover being removed, and FIG. 8(B) illustrates a longitudinal cross section taken at the portion C-C of FIG. 8(A) when a cavity cover 6B is attached.

In the filter 30, resonators R1, R23, R45, and R6 are arranged in an aluminum housing 6 forming a cavity therein and including a cavity main body 6A and the cavity cover 6B (FIG. 8(B)). Each of the resonators R23 and R45 is the dielectric resonator attached to the support table 5 (FIG. 8(B)) illustrated in FIG. 3, and the resonators R23 and R45 are disposed in opposite orientations in the x-axis direction. Each of the resonators R23 and R45 has a dual-resonant-mode in which the TE01δz mode and the TE01δy mode are coupled.

Each of the resonators R1 and R6 forms a semi-coaxial resonator, that is, includes a central conductor 11 having a predetermined height on the inner bottom surface of the cavity main body 6A. Coaxial connectors 12 are attached on the outer surface of the cavity main body 6A. The central conductor of each of the coaxial connectors 12 is connected to the central conductor 11. A frequency adjusting screw 13 (FIG. 8(B)) is attached on a part of the cavity cover 6B that faces the top of the central conductor 11. The resonant frequency of the semi-coaxial resonator is adjusted by adjusting the stray capacitance occurring between the frequency adjusting screw 13 and the top of the central conductor 11.

A window W (FIG. 8(A)) is disposed each of between the resonators R1 and R23 and between the resonators R45 and R6. The adjacent resonators are coupled through the window W. A partition plate 20 is arranged between the resonators R23 and R45. The partition plate 20 has a plurality of slit openings (not shown) extending along the z-axis direction. Because of the openings extending along the z-axis direction of the partition plate 20, magnetic fields occurring in the resonators R23 and R45 in the z-axis direction are coupled. The amount of this coupling of magnetic fields can be set at a desired value by the widths, lengths, and number of the slit openings. The partition plate 20 is provided with a conductor loop 21 having a loop surface that passes through a part of the openings and that is linked with a magnetic field in the y-axis direction. The conductor loop 21 complements a minute coupling in which magnetic-field components occurring in the resonators R23 and R45 in the y-axis direction are coupled through the slit openings of the partition plate 20. In some cases, depending on a desired filter characteristic, no coupling of the magnetic-field components occurring in the resonators R23 and R45 in the y-axis direction may be preferable. In such cases, the conductor loop 21 may be used to cancel the coupling.

As described above, the filter 30 uses the dielectric resonator 1 accommodated in the cavity 6. The size of the dielectric resonator 1 is small, so the size of the cavity 6 and the overall size of the filter 30 can be small. Because the percentage of the dielectric resonator 1 in the cavity 6 does not differ from that when a standard-shaped dielectric resonator is used, the frequency in the spurious mode (TM mode) occurring in the cavity 6 does not decrease, and a necessary pass-band characteristic can be readily obtained.

With the above configuration, the filter 30 can adjust a relative bandwidth by setting the amount of coupling of the resonant modes in the resonators. In particular, because the amount of coupling of a plurality of resonant modes (TE01δz mode and TE01δy mode) occurring in the dielectric resonator 1 according to the present invention can be set at a large value, the relative bandwidth can be set at a large value. Even in this case, the low-loss small filter 30 with an excellent Qu characteristic can be constructed.

In addition, even after the resonator according to the present invention is implemented into a filter, the amount of coupling in the resonator and the frequency can be simply adjusted, and a filter characteristic can be adjusted at a desired characteristic. This will be described with reference to FIG. 4(A).

In FIG. 4(A), if a part of the top surface of the plate component 2D is cut, the amount of coupling of two resonant modes occurring in the dielectric resonator 1 increases, and the frequency in the TE01δz mode increases. By contrast, if a part of the top surface of the plate component 2C is cut, the amount of coupling of two resonant modes occurring in the dielectric resonator 1 decreases, and the frequency in the TE01δz mode increases. If the top surface of each of the plate components 2C, 2D is cut by a predetermined amount, for example, the same amount, the amount of coupling of two resonant modes occurring in the dielectric resonator 1 is not changed, and the frequency in the TE01δz mode increases. If only the top surface of the plate component 2A is cut, only the frequency in the TE01δy mode increases.

In such a way, in the dielectric resonator according to the present invention, the frequency in the TE01δz mode and that in the TE01δy mode can be adjusted independently and the amount of coupling of the TE01δz mode and the TE01δy mode can also be adjusted. One specific suitable adjustment process is that several holes are formed at predetermined positions of the cavity cover 6B corresponding to the resonators R23 and R45, a diamond processing tool for adjustment is inserted through these holes, and a work surface (top surface) of the dielectric resonator 1 (each of the resonators R23 and R45) is cut. Similar adjustment can also be achieved by attaching a dielectric chip having a high permittivity and high Qu, instead of the cutting. In this case, even if the dielectric chip is attached to the same position as in the case of the cutting, the frequency in each mode varies in the direction opposite to that in the case of the cutting. The amount of coupling also varies in the direction opposite to that in the case of the cutting.

Figure 9:
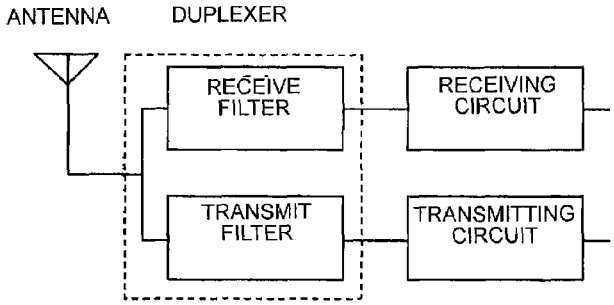
FIG. 9 is a configuration diagram of a communication device according to a another embodiment of the present invention.

Next, a configuration of a communication device for use in a base station in mobile communications according to a third embodiment of the present invention is illustrated in FIG. 9.

A duplexer in this communication device includes a transmit filter and a receive filter. Each of the transmit filter and the receive filter is the above-described filter for use in communication. The phase is adjusted between the output port of the transmit filter and the input port of the receive filter to block a transmission signal from intruding into the receive filter and a reception signal from intruding into the transmit filter. The port for inputting a transmission signal of the duplexer is connected to a transmitting circuit, and the port for outputting a reception signal thereof is connected to a receiving circuit. The antenna port thereof is connected to an antenna. In such a manner, the communication device including the dielectric resonator according to the present invention is constructed.

With the above-described configuration, in the communication device, a relative bandwidth can be adjusted by setting the amount of coupling of resonant modes in resonators included in the transmit filter and the receive filter. In particular, because the amount of coupling of a plurality of resonant modes (TE01δz mode and TE01δy mode) occurring in the dielectric resonator 1 according to the present invention can be set at a large value, the relative bandwidth can be set at a large value. Even in this case, the low-loss small communication device including the dielectric resonator 1 having an excellent Qu characteristic can be constructed.

The invention claimed is:

1. A dielectric resonator comprising:

first and second plate components having respective first and second principal center planes parallel with each other; and third and fourth plate components having respective third and fourth principal center planes parallel with each other and orthogonal to the respective first and second principal center planes of the first and second plate components, wherein a cross section of the dielectric resonator orthogonal to the first, second, third and fourth principal center planes has a substantially cruciform shape, wherein the first principal center plane of the first plate component and the second principal center plane of the second plate component are separated from each other, and a first TE01δ mode in which a first electric-field vector rotates within the first and second plate components and a second TE01δ mode in which a second electric-field vector rotates within the third and fourth plate components are coupled, wherein none of the plate components of the resonator are in direct contact with a conductive cavity, wherein the first principal center plane of the first plate component and the second principal center plane of the second plate component are separated from each other equally in opposite directions, and wherein the third principal center plane of the third plate component and the fourth principal center plane of the fourth plate component are separated from each other.

2. A dielectric filter comprising:

the dielectric resonator according to claim 1;

the conductor cavity accommodating the dielectric resonator therein;

a first input/output portion for inputting/outputting a signal while coupled to either the first or second TE01δ mode; and a second input/output portion for inputting/outputting a signal while being coupled to either the first or second TE01δ mode.

3. The dielectric filter according to claim 2, wherein at least one of the first and second input/output portions comprises a semi-coaxial cavity resonator.

4. A communication device comprising:

a radio-frequency circuit portion; and the dielectric filter according to claim 2 in the radio-frequency circuit portion.

5. The dielectric resonator according to claim 1, wherein an intersection of two adjacent plate components among the first to fourth plate components or a surface near to the intersection has at least one grooved portion.

6. A communication device comprising:

a radio-frequency circuit portion; and the dielectric resonator according to claim 1 in the radio-frequency circuit portion.

7. The dielectric resonator according to claim 1, wherein the third principal center plane of the third plate component and the fourth principal center plane of the fourth plate component are separated from each other equally in opposite directions.

8. A dielectric resonator comprising:

first and second plate components having respective first and second principal center parallel with each other; and third and fourth plate components having respective third and fourth principal center planes parallel with each other and orthogonal to the respective first and second principal center planes of the first and second plate components, wherein a cross section of the dielectric resonator orthogonal to the first, second, third and fourth principal center planes has a substantially cruciform shape, wherein the first principal center plane of the first plate component and the second principal plane of the second plate component are separated from each other, and a first TE01δ mode in which a first electric-field vector rotates within the first and second plate components and a second TE01δ mode in which a second electric-field vector rotates within the third and fourth plate components are coupled, wherein none of the plate components of the resonator are in direct contact with a conductive cavity, and wherein the third principal center plane of the third plate component and the fourth principal center plane of the fourth plate component are separated from each other.

9. The dielectric resonator according to claim 8, wherein the third principal center plane of the third plate component and the fourth principal center plane of the fourth plate component are separated from each other equally in opposite directions.

10. The dielectric resonator according to claim 8, wherein an intersection of two adjacent plate components among the first to fourth plate components or a surface near to the intersection has at least one grooved portion.

11. A dielectric filter comprising:

the dielectric resonator according to claim 8;

the conductor cavity accommodating the dielectric resonator therein;

a first input/output portion for inputting/outputting a signal while coupled to either the first or second TE01δ mode; and a second input/output portion for inputting/outputting a signal while being coupled to either the first or second TE01δ mode.

12. A communication device comprising:

a radio-frequency circuit portion; and the dielectric filter according to claim 11 in the radio-frequency circuit portion.

13. The dielectric filter according to claim 11, wherein at least one of the first and second input/output portions comprises a semi-coaxial cavity resonator.

14. A communication device comprising:

a radio-frequency circuit portion; and the dielectric resonator according to claim 8 in the radio-frequency circuit portion.

* * * * *